US006993146B2

(12) United States Patent
Sato

(10) Patent No.: US 6,993,146 B2
(45) Date of Patent: Jan. 31, 2006

(54) SPEAKER HAVING SPACER RING INSIDE FRAME

(75) Inventor: Eiji Sato, Tamaho-machi (JP)

(73) Assignee: Mineba Co., Ltd., Nagano-Ken (JP)

( * ) Notice: Subject to any disclaimer, the term of this patent is extended or adjusted under 35 U.S.C. 154(b) by 171 days.

(21) Appl. No.: 10/366,402

(22) Filed: Feb. 14, 2003

(65) Prior Publication Data

US 2003/0156731 A1 Aug. 21, 2003

(30) Foreign Application Priority Data

Feb. 15, 2002 (JP) ..... 2002-38927

(51) Int. Cl.
*H04R 1/02* (2006.01)

(52) U.S. Cl. ..... 381/398; 381/423

(58) Field of Classification Search ..... 381/396, 381/398, 403, 404, 405, 407, 423, 433, 412, 381/432; 181/171, 172
See application file for complete search history.

(56) References Cited

U.S. PATENT DOCUMENTS

| | | | | |
|---|---|---|---|---|
| 4,807,295 | A * | 2/1989 | Dombroski | 381/409 |
| 6,095,280 | A * | 8/2000 | Proni | 181/171 |
| 6,383,654 | B1 * | 5/2002 | Yabe et al. | 428/515 |
| 6,771,792 | B1 * | 8/2004 | Shirakawa | 381/412 |
| 2001/0017930 | A1 * | 8/2001 | Matsudo et al. | 381/412 |

* cited by examiner

*Primary Examiner*—Suhan Ni
*Assistant Examiner*—Brian Ensey
(74) *Attorney, Agent, or Firm*—Heller Ehrman LLP

(57) ABSTRACT

A speaker comprises: a magnetic circuit composed of a pot yoke, a magnet, and a pole piece; a diaphragm shaped conical, defining an outer periphery and an inner periphery, and having a surround half-rolled and fixedly disposed at the outer periphery and a voice coil bobbin with a voice coil wound thereon fixedly disposed at the inner periphery; a spider having an outer diameter equal to or larger than the outer diameter of the surround; a frame having the magnetic circuit fixedly disposed at its central opening; and a spacer ring fixedly disposed inside the frame, and having a surround edge receiving portion adapted to fixedly receive the entire outer edge of the surround thereon.

13 Claims, 7 Drawing Sheets

SPEAKER HAVING SPACER RING INSIDE FRAME

BACKGROUND OF THE INVENTION

1. Field of the Invention

The present invention relates to a speaker for use in TVs, radios, personal computers, and audio equipments, and more particularly to a speaker which is with a lowest resonant frequency, is good for reproducing a bass sound, and is excellent in durability and reliability.

2. Description of the Related Art

A dynamic speaker using a conical diaphragm is structured such that a diaphragm is disposed inside a frame so as to be suspended by way of a surround half-rolled and a spider, both of which work as suspensions, so that a voice coil bobbin having a voice coil wound thereon and fixedly attached to the inner perimeter of the diaphragm can move up and down accurately inside a magnetic circuit. In this structure, as is well known, the spider working as a suspension has a large influence on a lowest resonant frequency (fo) of a speaker, and the spider must be securely supported sideways. And, conventionally, the spider, which is disposed at the bottom part of the frame, has a smaller outer diameter smaller than the surround, which is disposed at the upper most part of the frame. In view of this fact, following speakers have been proposed.

First, a speaker has been proposed, in which the outer diameter of the diaphragm is set to be larger than the inner diameter of the surround shaped like a doughnut and consisting of a half-rolled portion, an outer edge (hereinafter referred to as "surround edge" as appropriate) and inner edge, the outer diameter of the spider is set to be larger than the outer diameter of the surround, and in which the diaphragm has its weight balanced due to the support at the inner diameter of the surround, thus preventing the diaphragm from rolling, and resulting in improved input. And, in the above proposed speaker, the outer diameter of the spider dimension can be increased without increasing the frame dimension in the diameter direction, thereby lowering the lowest resonant frequency (fo).

Second, a speaker has been proposed, in which the outer perimeter of the diaphragm is firmly held to the frame via the surround, either the inner peripheral end of the diaphragm or the voice coil bobbin is firmly held to the frame via the spider, cutaways are made at a portion which is formed at the upper most part of the frame and which is adapted to receive the surround edge (the portion to receive the surround edge is referred to as "surround edge receiving portion") thereby allowing the spider to get clear of the portion into the frame without its outer diameter decreased, enabling the outer diameter of the spider to be set to be larger than the outer diameter of the surround, and keeping or making the lowest resonant frequency (fo) as low as possible, and in which the portions of the surround edge corresponding to the cutaways are supported by a gasket or cardboard to be placed thereon The above described two speakers, in both of which the outer diameter of the spider is set to be larger than at least the outer diameter of the surround thereby making the lowest resonant frequency (fo) as low as possible, involve the following disadvantages.

In the first speaker, since the outer diameter. of the diaphragm is larger than the inner diameter of the surround, the diaphragm has to be uniquely configured such that the lower face of the outer periphery of the diaphragm is fixedly attached to the inner edge of the surround, and also since the entire weight balance of the diaphragm must be properly maintained, the production of the diaphragm is complicated. Further, the outer diameter of the yoke must be extended as far as to the joint with the frame. These factors will push up production cost.

On the other hand, in the second speaker, which is superior in that the configuration is not unique, since the cutaways must be made on the frame, the frame must be formed of a steel plate enabling the cutaways to be punched. As the steel plate has a small internal loss, the frame and the magnetic circuit must have butyl rubber or the like bonded on their surfaces so as to absorb the resonance generated by the diaphragm vibrating, which increases the number of constituent components thereby leading to increased cost.

Also, in the second speaker, the cutaways, which can be made on a frame shaped rectangular or elliptic, cannot be made when the frame is shaped circular. Further, in this speaker, since the outer edge of the surround has no support or protection provided on its lower face while having the gasket fixedly provided on its upper face, when the diaphragm moves downward considerably with a large input applied to the speaker, the surround including its outer edge is moved together downward considerably thereby possibly separating the surround edge from the gasket, which raises a problem with reliability.

SUMMARY OF THE INVENTION

The present invention has been made in the light of the above problems, and it is an object of the invention to provide a speaker, in which the outer diameter of the spider can be set to be equal to or larger than the outer diameter of the surround, and in which the surround outer is securely protected so as not to peel off when a large input is applied to the speaker, thereby enhancing the durability and accordingly the reliability as well. And another object thereof is to provide a speaker, in which no special means or components are required for keeping the frame free from resonance, which reduces the number of constituent components realizing cost reduction.

In order to achieve the objects, according to a first aspect of the present invention, the speaker comprises: a magnetic circuit composed of a pot yoke, a magnet, and a pole piece; a diaphragm shaped conical, defining an outer periphery and an inner periphery, having a surround half-rolled and fixedly disposed at the outer periphery, and having a voice coil bobbin including a voice coil and fixedly disposed at the inner periphery; a spider having an outer diameter equal to or larger than the outer diameter of the surround; a frame having the magnetic circuit fixedly disposed at its central opening; and a spacer ring fixedly disposed inside the frame, and having a portion adapted to fixedly receive the entire outer edge of the surround thereon (hereinafter the portion of the spacer ring for receiving the surround edge is referred to also as "surround edge receiving portion" like the portion of the frame for receiving the surround edge).

According to a second aspect of the present invention, in the speaker of the first aspect, the frame does not have, on its outer periphery, a surround edge receiving portion.

According to a third aspect of the present invention, in the speaker of the first aspect, the spacer ring further includes a plurality of legs fixedly provided on the lower face of the surround edge receiving portion.

According to a fourth aspect of the present invention, in the speaker of the first aspect, the spacer ring is shaped hollow-cylindrical, and has a predetermined wall thickness, and the surround edge receiving portion thereof is located at its upper end and configured to correspond to the outer edge of the surround.

According to a fifth aspect of the present invention, in the speaker of any one of the first, third and fourth aspects, the spacer ring is formed of a vibration absorbing material of ABS resin or elastomer.

According to a sixth aspect of the present invention, the speaker comprises: a magnetic circuit composed of a pot yoke, a magnet, and a pole piece; a diaphragm shaped conical, defining an outer periphery and an inner periphery, having a surround half-rolled, including an outer edge and inner edge and fixedly disposed at the outer periphery, and having a voice coil bobbin including a voice coil and fixedly disposed at the inner periphery; a spider having an outer diameter equal to or larger than the outer diameter of the surround; a frame having the magnetic circuit fixedly disposed at its central opening, and including a surround edge receiving portion provided with two cutaways positioned so as to oppose each other and allow the spider into the frame; and a spacer ring fixedly disposed inside the frame, and comprising a ring-shaped main body, and two blocks disposed on the upper face of the main body, and shaped and positioned so as to engage respectively with the two cutaways made at the surround edge receiving portion of the frame thereby making the surround edge receiving portion complete to receive entirely the outer edge of the surround.

According to a seventh aspect of the present invention, in the speaker of the sixth aspect, the diaphragm is shaped elliptic or rectangular, the spider has an outer diameter equal or larger than the outer diameter of a minor axis of the surround edge, and the two cutaways are formed respectively at two places of the surround edge receiving portion of the frame, where the two places are positioned at a center of a major axis direction of the diaphragm and oppose each other across the center of the frame.

According to an eighth aspect of the present invention, in the speaker of the sixth or seventh aspect, the spacer ring is formed of a vibration absorbing material of ABS resin or elastomer.

In the present invention, since the outer edge of the surround fixedly attached to the diaphragm is bonded to the surround edge receiving portion provided on the spacer ring which is disposed inside the frame, the diaphragm and the voice coil bobbin with the voice coil wound thereon can be securely held in a prescribed position by means of the surround and the spider both functioning as suspensions, with the spider having an outer diameter equal to or larger than the outer diameter of the surround. Accordingly, the speaker of the present invention has its lowest resonant frequency (fo) kept as low as possible and is good for reproducing a bass sound.

Also, since the spacer is adapted to receive the entire outer edge of the surround regardless of the configuration of the diaphragm, the spider can always be dimensioned to have an outer diameter equal to or larger than the outer diameter of the surround regardless of the type of speaker. This also enables the entire outer edge of the surround to be sandwiched between the spacer ring and the gasket, so that the surround edge does not peel off even when the diaphragm vibrates heavily with a large input, thereby enhancing durability and therefore reliability.

Further, since the spacer ring is formed of ABS resin or elastomer, vibration from the diaphragm is absorbed quickly. Accordingly, the frame and the magnetic circuit do not have to have a vibration absorbing material bonded thereon, resulting in reduced production cost.

BRIEF DESCRITION OF THE DRAWINGS

The above objects and other advantages of the present invention will become more apparent by describing in detail preferred embodiments of the present invention with reference to the attached drawings in which.

DESCRIPTION OF THE PREFERRED EMBODIMENTS

Preferred embodiments of the present invention will be described in detail with reference to the drawings.

Figure 1:
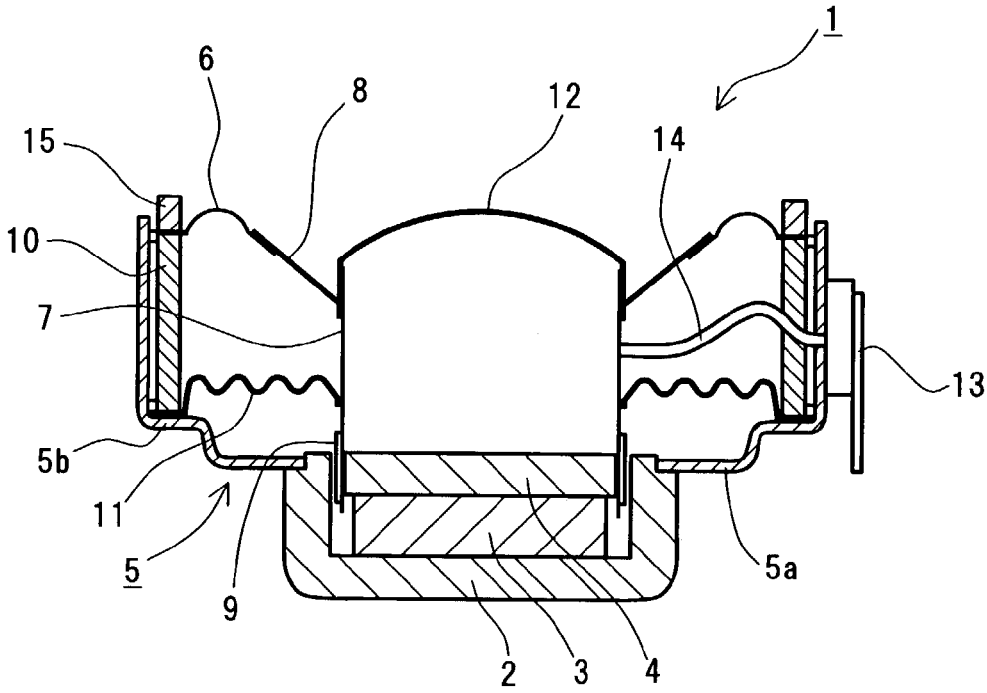
FIG. 1 is a cross-sectional view of a speaker according to an embodiment of the present invention.
Figure 3:
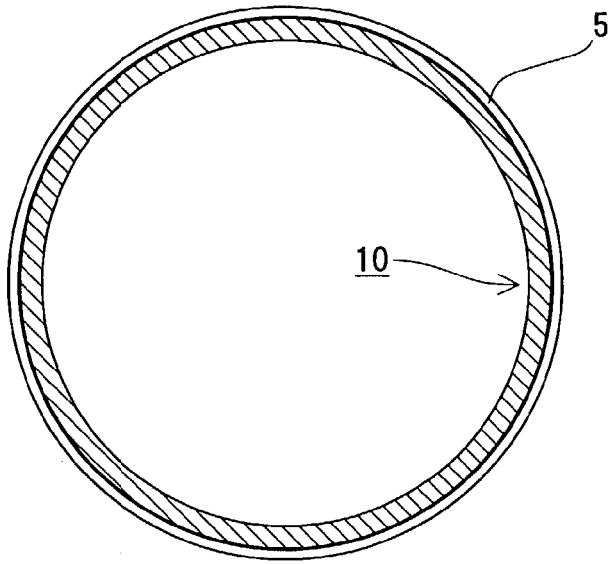
FIG. 3 is a sectional plan view of the spacer ring of FIG. 2 mounted in the speaker.

Referring to FIG. 1, a speaker 1 of the present invention generally comprises: a magnetic circuit comprising a pot yoke 2 shaped hollow-cylindrical and having a closed bottom and an open top, a magnet 3 formed of a permanent magnet, shaped cylindrical, and disposed at the center of the bottom of the pot yoke 2, and pole piece 4; a frame 5 joined to the magnetic circuit; a surround 6 shaped like a doughnut and consisting of a half-rolled portion, an outer edge (numbered 6*a* in FIGS. 6 and 7 and to be referred to as "surround edge" as appropriate), and an inner edge; a voice coil bobbin 7; a voice coil 9 wound on the voice coil bobbin 7; a diaphragm 8 defining an outer periphery and an inner periphery, and having the surround 6 on the outer periphery and the voice coil bobbin 7 on the inner periphery; a spacer ring 10 fixedly disposed inside the frame 5 as shown in FIG. 3; and a spider 11 defining an outer periphery and an inner periphery, and having an outer diameter equal to or larger than the outer diameter of the surround.

The speaker 1 further includes: a dust cap 12 attached to the upper end of the voice coil bobbin 7; a terminal 13 attached to a predetermined portion of the frame 5; two lead wires 14 (only one is shown in the figure); and a gasket 15 placed on the upper face of the outer edge 6*a* (see FIGS. 6 and 7) of the surround 6.

The speaker of the present invention has the greatest feature in that in case of a diaphragm having a circular configuration, a spider having an outer diameter equal to or larger than the outer diameter of a surround can be used, and that in case of a diaphragm having an elliptic or rectangular configuration, a spider having an outer diameter equal to or larger than the outer diameter of a surround in the minor axis can be used.

Figure 6:
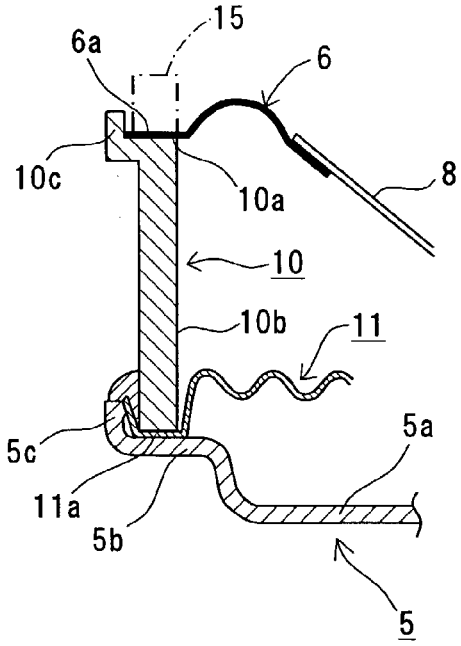
FIG. 6 is a cross-sectional view of a spacer ring according to yet another embodiment of the present invention.

The frame 5 is joined rigidly to the magnetic circuit, and has no specific restrictions on its configuration as long as it includes a holding part 5*b* that can fixedly hold the spacer ring 10 and the spider 11 in place. For example, as shown in FIG. 6, the frame 5 may be structured such that a holding part 5*b* is provided in parallel to a frame main part 5*a* and continuous therewith via a wall extending substantially vertically from the outer circumference of the frame main part 5*a*, and a low wall 5*c* extends vertically from the outer circumference of the holding part 5*b*, wherein the height of the frame 5 may be flexibly defined by the height of the spacer ring 10. Also, as shown in FIG. 7, the frame 5 may be structured such that a holding part 5*b* is provided in parallel to a frame main part 5*a* and continuous therewith via a wall extending substantially vertically from the outer circumference of the frame main part 5*a*, and a high wall 5*c* extends vertically from the outer circumference of the holding part 5*b*.

Figure 7:
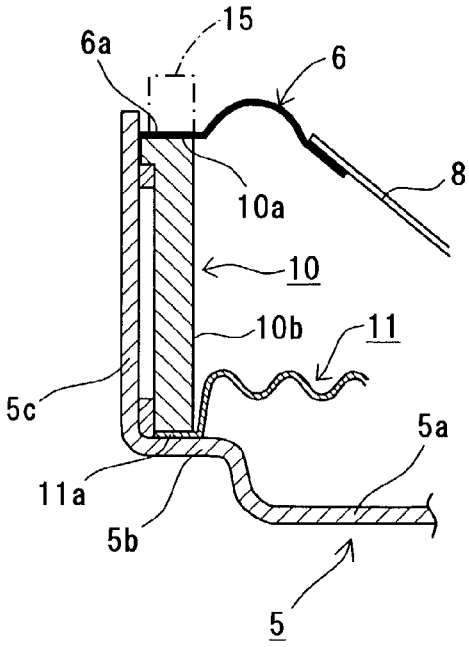
FIG. 7 is a cross-sectional view of a spacer ring according to a further embodiment of the present invention.

In both of the above examples shown in FIGS. 6 and 7, the outer periphery of the spider 11 is bonded to the holding part 5*b*, and the spacer ring 10 is mounted with its lower ends bonded onto the outer periphery of the spider 11, thus eliminating the requirement of forming a flange wall integrally with the frame 5 so as to provide a surround edge receiving portion 10*a* for receiving and bonding the outer edge 6*a* of the surround 6 to, thereby making the production of the frame 5 simple and easy reducing the production cost.

The diaphragm 8 is shaped conical, has a circular opening at the central portion for receiving the voice coil bobbin 7, and has its outer configuration shaped circular, elliptic, square or rectangular, and the surround 6 is fixedly attached to the diaphragm 8 such that the inner edge 6*a* of the surround 6 is bonded to the outer periphery of the diaphragm 8. Naturally, the surround 6 is shaped circular, elliptic, square or rectangular in accordance with the configuration of the diaphragm 8, and may be half-rolled upward or downward.

The spacer 10 ring may be molded of a material such as ABS resin, or thermoplastic elastomer, or may alternatively be formed of vulcanized rubber such as butyl-rubber, nitrile rubber, styrene-butadiene rubber, chlorinated polyethylene rubber, or ethylene-propylene rubber. The spacer ring 10 has no specific restrictions on its configuration and material as long as it includes the surround edge receiving portion 10*a* for receiving entirely the outer edge 6*a* of the surround 6 attached to the outer periphery of the diaphragm 8 and is fixedly disposed inside the frame 5.

Figure 2:
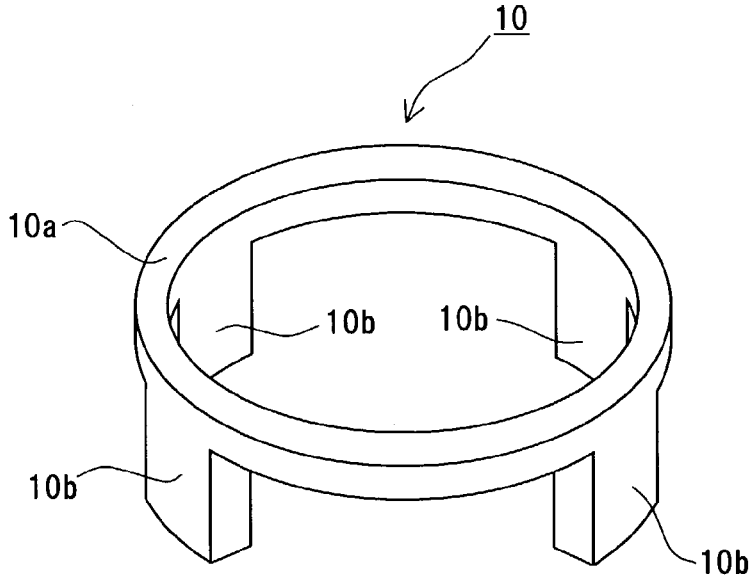
FIG. 2 is a perspective view of a spacer ring of the speaker of FIG. 1.

In case of a diaphragm having a circular outer configuration, the surround 6 also has a circular outer configuration, and the spacer ring 10 is structured as shown in FIG. 2 such that the surround edge receiving portion 10*a* shaped like a circular ring so as to receive the entire outer edge 6*a* of the circular-shaped surround 6 has, on its lower face, a plurality (four in the figure) of legs 10*b* at regular intervals. The legs 10*b* are to be fixed on the outer periphery of the spider 11 placed on the holding part 5*b* of the frame 5.

Figure 4:
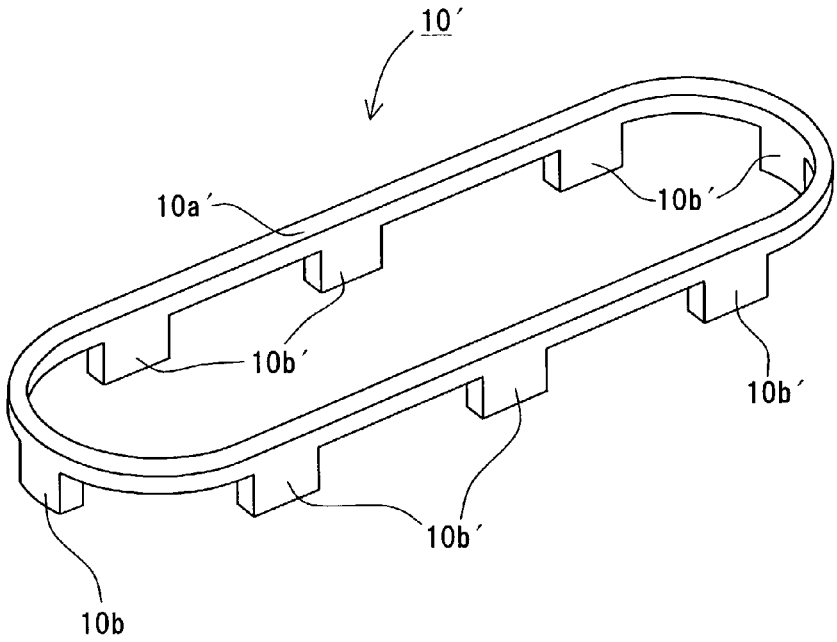
FIG. 4 is a perspective view of a spacer ring according to another embodiment of the present invention.
Figure 5:
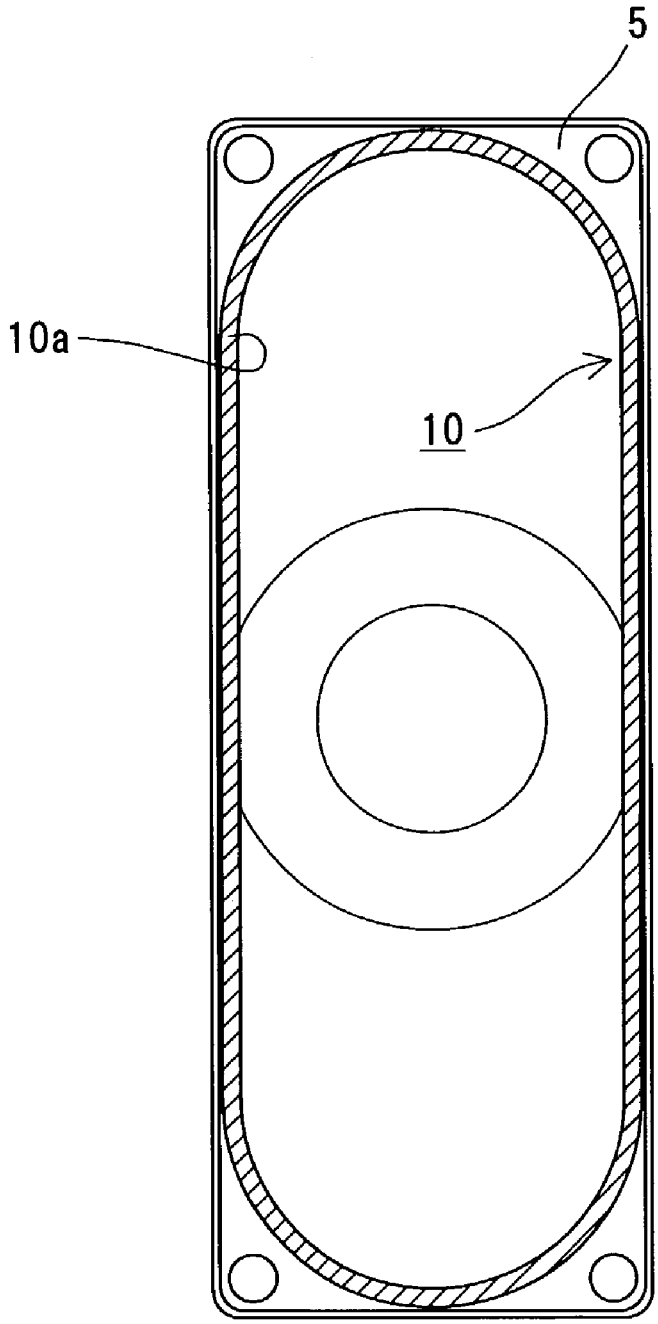
FIG. 5 is a sectional plan view of the spacer ring of FIG. 4 mounted in the speaker.

In case of a diaphragm having an elliptic outer configuration (see FIG. 5), the surround 6 also has an elliptic outer configuration, and the spacer ring 10 is modified into a spacer ring 10', which is structured as shown in FIG. 4 such that a surround edge receiving portion 10*a*' shaped like an elliptic ring so as to receive the entire edge of an elliptic-shaped surround 6 has, on its lower face, a plurality (eight in the figure) of legs 10*b*' at substantially equal intervals.

The surround edge receiving portion 10*a* of the spacer 10 has no specific restrictions on its configuration, as long as the outer edge 6*a* of the surround 6 can be fixed thereto in parallel to the magnetic circuit as shown in FIG. 1. The spacer ring 10 may have, as shown in FIG. 6, a flange extending horizontally from the surround edge receiving portion 10*a* so as to be flush therewith, and a wall 10*c* extending vertically from the outer circumference of the flange.

Further, as shown in FIG. 7, the spacer ring 10 may have a flange extending slightly and horizontally from the surround edge receiving portion 10*a* so as to be flush therewith, and the circumferential face of the flange comes in contact with the inner surface of the wall 5*c* of the frame 5 whereby the spacer ring 10 is positioned in place. Here, an adhesive may be partly filled, as needed, in a gap formed between the inner surface of the wall 5*c* and the outer surface of the spacer ring 10.

In the above embodiment, the spacer ring 10 comprises the surround edge receiving portion 10*a* for receiving the entire outer edge 6*a* of the surround 6, and the plurality of legs 10*b* to be fixed on the outer periphery of the spider 11 placed on the holding part 5*b* of the frame 5, but in case of a circular diaphragm, thought not shown, the spacer ring 10 may alternatively be formed of a hollow-cylinder having a predetermined height and a predetermine wall thickness, and having a plurality of air vents provided at the wall while the frame 5 is configured as shown in FIG. 6, wherein the spacer ring 10 functions as a part of the frame 5.

The speaker 1 comprising the components above described is assembled such that the magnetic circuit comprising the pot yoke 2, the magnet 3 and the pole piece 4 is fixed at the central opening of the frame 5, the outer periphery 11*a* of the spider 11 is fixed to the holding part 5*b* of the frame 5 by adhesive, the spacer ring 10 is put and bonded onto the upper face of the outer periphery 11*a* of the spider 11, the outer edge 6*a* of the surround 6 having its inner edge bonded to the outer periphery of the diaphragm 8 is bonded to the surround edge receiving portion 10*a* of the spacer ring 10, the gasket 15 is bonded to the upper face of the outer edge 6*a* of the surround 6, and that the voice coil bobbin 7 having the voice coil 9 at its lower end portion is disposed such that its upper end portion is fixed to the inner perimeter of the diaphragm 8, and its middle portion is fixed to the inner perimeter of the spider 11, while its lower end portion provided with the voice coil 9 is positioned in a magnetic gap of the magnetic circuit and kept free from contact with any portions of the magnetic circuit.

The speaker 1 thus assembled can use the spider 11 having an outer diameter equal to or larger than the outer diameter of the surround 6 regardless of the configuration of the diaphragm 8, whereby the lowest resonant frequency (fo) can be kept as low as possible, which puts the speaker 1 in a advantageous position for reproducing a bass sound.

Figure 8:
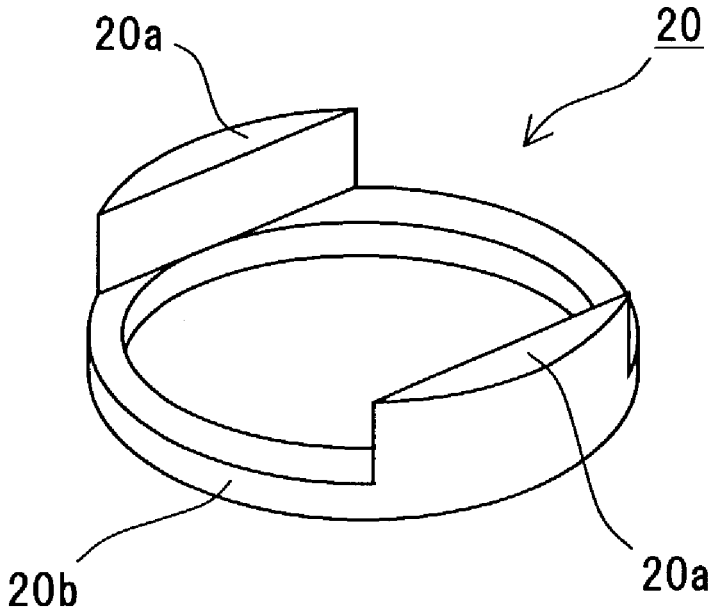
FIG. 8 is a perspective view of a spacer ring according to a still further embodiment of the present invention.
Figure 9:
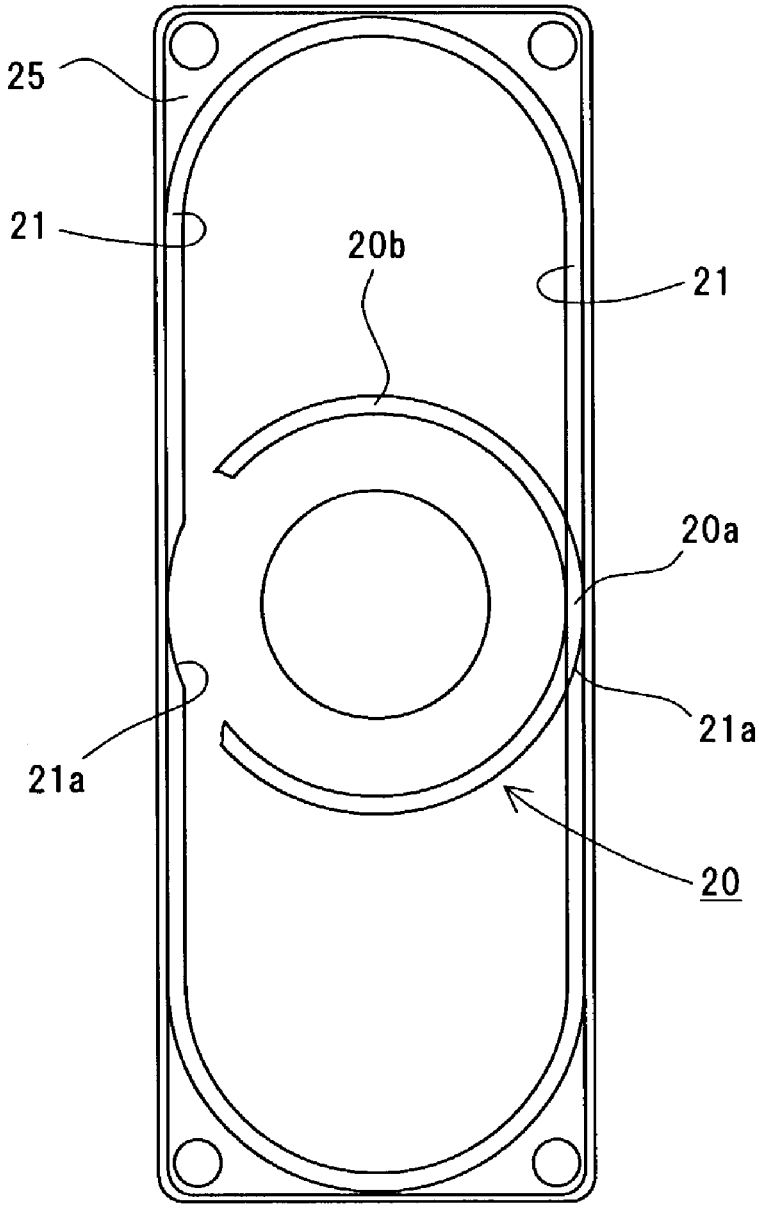
FIG. 9 is a partially cut-away plan view of the spacer ring of FIG. 8 mounted in the speaker.

FIG. 8 shows a spacer ring 20, which is applied in a speaker comprising (as shown in FIG. 9): an elliptic or rectangular diaphragm; a spider having an outer diameter larger than the outer diameter of the minor axis of the surround roll of the surround 6; and a frame 25 having a rectangular configuration and including a surround edge receiving portion 21 provided with two cutaways 21*a*, 21*a* respectively positioned at the center of the major axis direction so as to oppose each other across the center point The spacer ring 20 is formed of a vibration absorbing material such as ABS, elastomer, and comprises, as shown in FIG. 8, a ring-shaped main body 20*b* to be set concentric with the magnetic circuit joined to the frame 25, and two blocks 20*a*, 20*a* formed integrally with the ring-shaped main body 20*b* as a single piece, and shaped and positioned so as to engage with respective cutaways 21*a*, 21*a* described above when the spacer ring 20 is set in the frame 25 as shown in FIG. 9.

Accordingly, if the spacer ring 20 is duly set in the frame 25, the engagement makes the surround edge receiving portion 21 complete so as to receive the entire outer edge of the surround. So, if the diaphragm is moved considerably up and down with a large input, the outer edge of the surround does not peel off at any area, thus securing durability for high reliability.

What is claimed is:

1. A speaker comprising:

a magnetic circuit composed of a pot yoke, a magnet, and a pole piece;

a conical shaped diaphragm defining an outer periphery and an inner periphery, having a surround half-rolled and fixedly disposed at the outer periphery, and having a voice coil bobbin provided with a voice coil would thereon and fixedly disposed at the inner periphery;

a frame having the magnetic circuit fixedly disposed at its central opening;

a spacer ring provided separate from the frame, the spacer ring disposed within an outer circumference of the frame, and having a surround edge receiving portion adapted to fixedly receive an entire outer edge of the surround at an upper end portion thereof; and a spider connected between the voice coil bobbin and a lower end portion of the spacer ring.

2. A speaker according to claim 1, wherein the outer edge of the surround is not directly connected to the frame, but to the spacer ring.

3. A speaker according to claim 1, wherein the spacer ring further includes a plurality of legs extending to the lower end portion thereof.

4. A speaker according to claim 1, wherein the spacer ring is a hollow-cylindrical shape and has a predetermined wall thickness, and the surround edge receiving portion thereof is located at the upper end portion thereof and configured to correspond to the outer edge of the surround.

5. A speaker according to one of claims 1, 3 and 4, wherein the spacer ring is formed of a vibration absorbing material of one of ABS resin and elastomer.

6. A speaker comprising:

a magnetic circuit composed of a pot yoke, a magnet, and a pole piece;

a conical shaped diaphragm defining an outer periphery and an inner periphery, and having a surround half-rolled and fixedly disposed at the outer periphery and a voice coil bobbin with a voice coil would thereon fixedly disposed at the inner periphery;

a spider having an outer diameter equal to or larger than an outer diameter of the surround;

a frame having the magnetic circuit fixedly disposed at its central opening, and including a surround edge receiving portion adapted to fixedly receive an outer edge of the surround thereon, the surround edge receiving portion having two cutaways positioned so as to oppose each other and allow the spider to get clear thereof into the frame; and a spacer ring, the spacer ring disposed within an outer circumference of the frame, and including a ring-shaped main body and two blocks disposed on an upper face of the main body, the two blocks being shaped and positioned so as to engage respectively with the two cutaways made at the surround edge receiving portion of the frame thereby making the surround edge receiving portion completion to receiving entirely the outer edge of the surround.

7. A speaker according to claim 6, wherein the diaphragm is of one of elliptic and rectangular shapes, the spider has an outer diameter equal to or larger than an outer diameter of a minor axis of the surround, and the two cutaways are formed at respective two places of the surround edge receiving portion of the frame, the two places being positioned at a center of a major axis direction of the diaphragm and opposing each other across a center of the frame.

8. A speaker according to claim 6 or 7, wherein the spacer ring is formed of a vibration absorbing material of one of ABS resin and elastomer.

9. A speaker according to claim 1, wherein the frame includes:

a holding part which fixes the spacer ring; and a wall which extends upward from an outer circumference of the holding part.

10. A speaker according to claim 1, wherein the spacer ring has a wall which extends outwardly and upwardly from the upper end portion thereof.

11. A speaker according to claim 10, wherein an end of the outer edge of the surround is fixed adjacent to the wall.

12. A speaker according to claim 1, wherein the spider has an outer diameter equal to or larger than an outer diameter of the surround.

13. A speaker according to claim 4, wherein the spacer ring has a plurality of air vents formed separate from each other.

* * * * *

UNITED STATES PATENT AND TRADEMARK OFFICE

CERTIFICATE OF CORRECTION

PATENT NO. : 6,993,146 B2
APPLICATION NO. : 10/366402
DATED : January 31, 2006
INVENTOR(S) : Eiji Sato It is certified that error appears in the above-identified patent and that said Letters Patent is hereby corrected as shown below:

On the Title Page of the Patent under (73) Assignee, please change "Mineba Co., Ltd." to --Minebea Co., Ltd.--

Signed and Sealed this

Eleventh Day of July, 2006

JON W. DUDAS
*Director of the United States Patent and Trademark Office*